United States Patent [19]

Ball

[11] 4,182,088

[45] Jan. 8, 1980

[54] INTERIOR MOUNTED WINDOW BARRIERS AND CHANNEL MEMBERS THEREFOR

[76] Inventor: Duane L. Ball, 6654 Shenandoah Dr., Reynoldsburg, Ohio 43068

[21] Appl. No.: 889,348

[22] Filed: Mar. 23, 1978

[51] Int. Cl.[2] ..... E04B 5/52; E06B 3/28

[52] U.S. Cl. ..... 52/202; 52/476; 160/395; 52/420

[58] Field of Search ..... 52/202, 203, 476, 307, 52/308, 171, 172, 420; 160/392, 395

[56] References Cited

U.S. PATENT DOCUMENTS

| | | | |
|---|---|---|---|
| 3,371,702 | 3/1968 | Keegan et al. | 160/395 |
| 3,991,806 | 11/1976 | Abell | 160/395 |
| 4,068,428 | 1/1978 | Peterson | 52/202 |
| 4,069,641 | 1/1978 | DeZutter | 52/202 |
| 4,092,813 | 6/1978 | Eggert | 52/403 |

FOREIGN PATENT DOCUMENTS

| | | | |
|---|---|---|---|
| 2290559 | 6/1976 | France | 52/202 |
| 1037236 | 7/1966 | United Kingdom | 160/392 |

*Primary Examiner*—James L. Ridgill, Jr.
*Attorney, Agent, or Firm*—Frank H. Foster

[57] ABSTRACT

An extruded channel member is disclosed for attachment to the frame of a window or door for supporting and retaining a window barrier. The channel member has a relatively flat leg for sealing against the frame and a generally hook shaped leg attached to the flat leg and forming a longitudinal channel which opens substantially parallel to the flat leg. Preferably, the channel member is shaped in cross-section like a shepherd's crook. The channel members are sealingly attached in end-to-end relationship to the window frame and surround the window or door. A transparent barrier is mounted to the channel members to provide a sealed, insulating, dead air space between the room and the primary, all weather window pane. For use with a relatively rigid secondary barrier formed of a sheet of window pane material, or for use with a stiff flexible film such as Mylar, the channel members are attached with their channels opening inwardly toward the center of the window. The relatively rigid barrier is framed and supported within the surrounding channels. For use with a flexible film barrier, the channel members are attached with the channels opening away from the window. The transparent, flexible, synthetic resin film is cut so it is sufficiently long and wide to extend beyond all the mounted channel members. Near its periphery the film is clamped in the channels between the interior walls of the channels and rod-like members which are inserted in the channels after the film. For use with a relatively stiff flexible film, the rod-like members are also used to clamp the film.

7 Claims, 14 Drawing Figures

INTERIOR MOUNTED WINDOW BARRIERS AND CHANNEL MEMBERS THEREFOR

BACKGROUND OF THE INVENTION

This invention relates generally to energy conservation through the substantial reduction of heat loss through closures used in building structures such as homes and more particularly relates to channel members and their use to construct a secondary window barrier which may be easily, conveniently, inexpensively, and rapidly mounted to the frame of a door, window or the like.

Architects, engineers and most home owners recognize that doors and windows on exterior walls allow major heat losses far in excess of their relative cross-sectional areas.

In order to reduce this heat loss and thereby save fuel, energy and expense, secondary windows or storm windows conventionally have been provided exteriorly of the permanent all season windows. Conventional storm windows are desirable and exhibit some advantageous characteristics. They are, however, very expensive and require substantial time and effort for installation. Furthermore, they do not provide a barrier which is entirely sealed against air leakage.

Some people have attached synthetic resin films to the outside of the window frames exteriorly of the permanent all-season windows. This is usually done using batten strips which are nailed through the film and into the window frames. The film applied in this manner is not only unsightly but further is subject to wind damage and usually tears loose during its first season of application. Furthermore, even film which is not torn is not reuseable in subsequent years because of the holes caused by nailing through the film.

Still other persons have used rigid storm windows mounted interiorly of the all-season windows. While these provide important insulating characteristics they are more expensive than film barriers and those heretofore known must be custom precut to the exact size of each window. They too do not provide an air tight seal.

For my own use I have attempted in the past to tape a synthetic resin film to the interior window frame of windows in my home. However, I have found this to be unsatisfactory for several reasons. Substantial portions of the tape tend to release from the frame in the middle of the winter season. Furthermore, attempts to remove the remaining tape at the end of the season pulls portions of the paint from the window frame. In addition, attempts to remove the tape from the synthetic resin film so that it may be reused have resulted in tearing the film. Even where the tape is removed a residual gummy substance remains on the edges of the film which is difficult to remove or causes the film to stick to itself along the edges when rolled up and the gummy substance is not removed.

OBJECTS AND SUMMARY OF THE INVENTION

Accordingly, it is an object of the present invention to provide channel members having an alternate or dual utility which permits their use in the construction of sealed secondary barriers which utilize either synthetic resin films or relatively rigid window pane materials.

Another object of the present invention is to provide such channels which are constructed to apply a spring tension force on the film or rigid window pane material to assure a continuous seal.

It is another object of my invention to provide heat loss barriers which may be easily, conveniently and inexpensively mounted interiorly of the all-season window and which consequently are not subject to wind damage.

Another object of the present invention is to provide a film barrier which does not require precutting of the synthetic resin film to close tolerances and which permits the film to be reused for several years thereby eliminating the need for a yearly purchase of plastic film and adhesive masking tape and annual measuring, cutting and fitting of new sheets. For air-conditioning purposes barriers may be left in place during warm months.

A still further object is to provide a rigid sheet barrier which can be installed without the necessity of being sawed or cut to a precise window frame size.

Further objects and features of the present invention will be apparent from the following specification and claims when considered in connection with the accompanying drawings illustrating the preferred embodiment of the invention.

In summary, the channel member of the present invention has a relatively flat leg for sealing against a window or door frame and a generally hook shaped leg attached to the flat leg and forming a longitudinal channel which opens substantially parallel to the flat leg.

Channel members of this type may be used to construct a secondary window barrier utilizing a rigid window pane material by attaching the channel members in end-to-end relationship around the frame with the channels opening toward the center of the frame. A sheet of planar window pane material is mounted in these channels with its edges extending into the channels for retaining the window pane material in attachment to the window frame.

A film barrier according to the present invention has a plurality of such channel members, attached in end-to-end relationship surrounding the window or door frame with the channels opening away from the center of the frame. A flexible, synthetic film, which is dimensioned to extend beyond the channels, has it peripheral regions extending through the channels and an elongated rod-like member is inserted in the channels and clamps the peripheral regions of the film between the rod-like members and the channel members.

Figure 1:
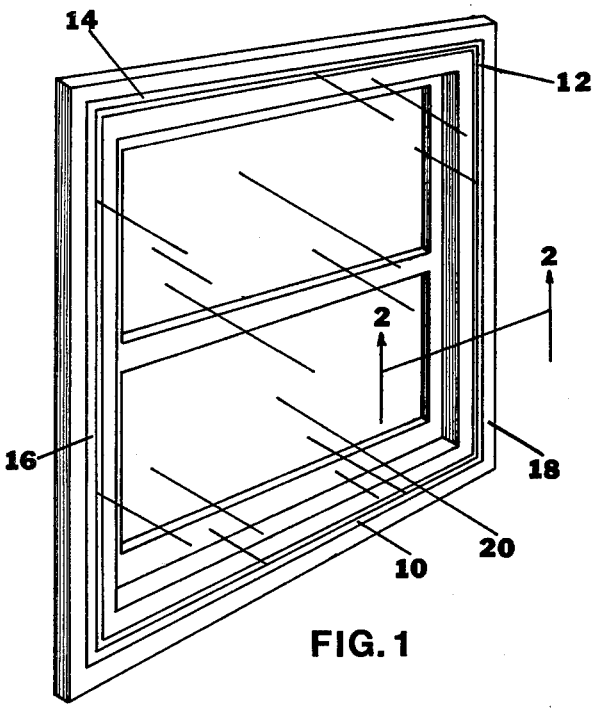
FIG. 1 is a view in perspective of a residential window having a film barrier mounted thereon which is constructed according to the present invention.

In describing the preferred embodiment of the invention illustrated in the drawings, specific terminology will be resorted to for the sake of clarity, however, it is not intended to be limited to the specific terms so selected and is to be understood that each specific term includes all technical equivalents which operate in a similar manner to accomplish a similar purpose.

DETAILED DESCRIPTION

FIG. 1 illustrates a film barrier of the invention mounted to the interior frame of a residential window 18.

The barrier structure has four channel members 10, 12, 14 and 16, attached in end-to-end relationship around the window frame 18 so as to surround the entire window. A transparent, flexible, synthetic resin film 20 is sufficiently large so that prior to its installation it will extend beyond each of the channel members 10 through 16.

The transparent film may, for example, be 4 mil or 6 mil polyethylene film or other similarly pliable film and, while preferably transparent for window use, may also be opaque, such as the conventional black plastics films sold for agricultural purposes.

Figure 2:
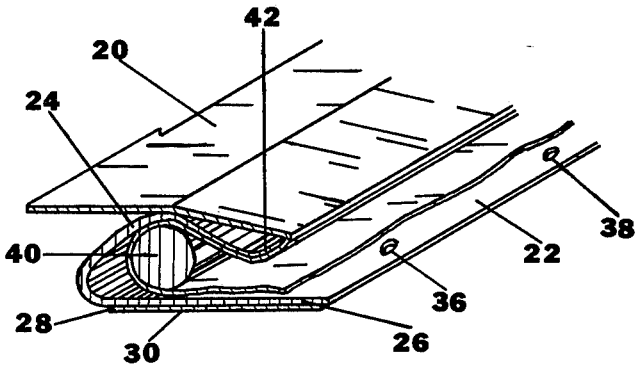
FIG. 2 is a view in perspective and in section taken substantially along the lines 2—2 of FIG. 1 illustrating a channel member, film and rod-like member assembled in accordance with the present invention.

Referring to FIG. 2, each channel member in cross-section has a relatively flat leg 22 for sealing engagement against the window frame 18 and a generally hook-shaped leg 24 which is attached to the flat leg 22 to form a longitudinal channel 26. The longitudinal channel 26 opens substantially parallel to the flat leg 22 so that when the channel member is mounted to the window frame 18 the channels will open laterally away from the center of the window frame; that is away from the window.

Preferably each channel member is resiliently flexible and has a cross-section in the shape of a sheperd's crook as illustrated in FIG. 2. I also prefer that the channel members are of unitary construction and made of vinyl according to conventional extrusion techniques.

Figure 3:
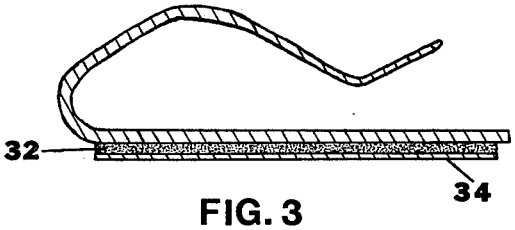
FIG. 3 is a view in cross-section illustrating the use of a resilient gasket seal in an embodiment of the invention.

In order to provide a convenient means for attaching the channel members 10–16 to the window frame 18, a layer of pressure sensitive adhesive 28 is bonded to the outer surface of the flat leg 22 and covered with a peelable release paper 30. Alternatively, improved sealing between the channel members and the window frame 18, is attained by a resilient gasket strip 32 which is bonded at one of its faces to the outer surface of the flat leg as illustrated in FIG. 3 and having pressure sensitive adhesive 34 bonded to its opposite face.

If additional mounting strength is desired, a plurality of longitudinally spaced holes, such as holes 36 and 38, illustrated in FIG. 2, may be formed through the flat leg 26 to permit insertion of fasteners such as brads or screws.

Elongated rod-like members, such as rod-like member 40, are used to clamp the peripheral regions of the film 20 between the rod-like members and interior channel walls of the channel members as shown in FIG. 2. The greatest width of the channel is where the rod-like members seat and is dimensioned so that the channel will matingly receive and releasably retain the rod-like members and the interposed layer of film within the channel under a spring-like tension. The hooked shaped leg is preferably formed with a lip 42 which provides provides easy entry for the rod and a narrowed region to resist withdrawal of the rod and film from the channel.

When the channel members are constructed of a relatively resilient material, the rod-like members, such as rod-like member 40, may be relatively rigid. With this construction the deflection of the channel members permits insertion of the rod-like members. The rigid, rod-like members also resist the tendancy of the film to wrinkle.

Alternatively, however, the channel members may be relatively rigid and the rod-like members relatively resiliently compressible so that the rod-like members and the film may be inserted in the channels by forced deformation of the rod-like members. For example, the channel members might be constructed of extruded or stamped aluminum and the rod-like members might be constructed of neoprene, butyl rubber or flexible plastic tubing. As another alternative, the rod-like members may also be constructed of rope or cord for specific applications.

A channel member of the type illustrated in FIG. 2 embodying the present invention has the additional advantage that it may alternatively be used to support a relatively rigid type of window pane material, such as acrylic or styrene sheets, sealingly against the window frame to provide a relatively rigid secondary barrier. However, as illustrated in FIG. 4, the relative dimensions of the channel member may advantageously be modified form the proportional dimensions illustrated in FIG. 2 so that it will better accomodate the relatively planar window pane material.

Figure 4:
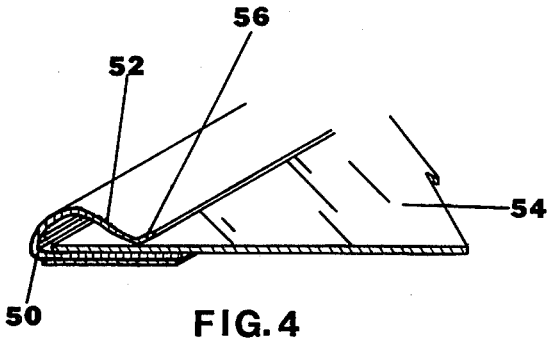
FIG. 4 is a view in cross-section illustrating an alternative channel member embodying the present invention and also illustrating the retention of a relatively rigid window pane material within the channel member.

The channel member 50 shown in FIG. 4 has an extended hook-shaped leg 52 so that the channel is deeper. The deepened channel allows greater error tolerances in the cutting of the window pane material and allows additional space for thermal expansion and contraction. The narrowest width of the channel immediately below the lip 56 is preferably constructed slightly smaller than the thickness of the window pane material 54 so that the resilient flexure of the channel member will apply a sealing spring tension against the surface of the window pane material 54.

The same types of attaching means and sealing gaskets as described above, such as adhesive and foam strips, may be used to sealingly bond the channel members to the window frame when a relatively rigid window pane material is used.

However, the channels are connected in end-to-end relationship around the frame with the channels opening inwardly toward the center of the frame rather than opening outwardly away from the center as they are oriented for use with flexible films.

Figure 7:
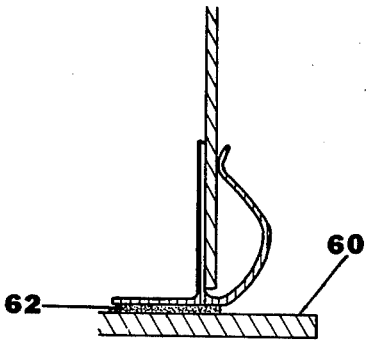
FIG. 7 is a view in cross-section illustrating an alternative channel member and gasket structure for mounting a relatively rigid window pane in a channel member which is attached to the sill of the window.

In order to sealingly mount the channel member against a window sill, such as the window sill 60 illustrated in FIG. 7, an additional leg or flange 62 may be formed during extrusion. The adhesive-backed gasket material 63 is attached to the flange 62 and, upon mounting to the window, is adhesively bonded to the upper surface of the sill 60.

The fastening means for attaching the channel members to the window frame when they are used to support a relatively rigid window pane material may be releasable fasteners, such as for example those sold under the trademark Velcro. Relatively small adhesive backed pads of such releasable fastening material may be spaced along the channel members, for example, every eight to twelve inches. Mating pads are adhered to the window frame at corresponding positions.

Figure 5:
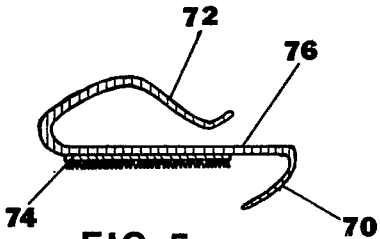
FIG. 5 is a view in section illustrating an alternative channel member with a sealing lip embodying the present invention.
Figure 6:
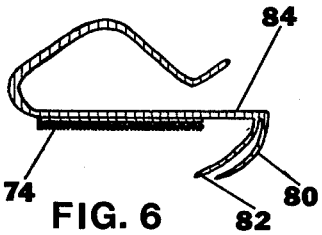
FIG. 6 is a view in cross-section illustrating still another channel member having an alternative sealing lip embodying the present invention.

In order to provide a seal between the channel members and the window frame, a flexible lip, such as the lip 70 illustrated in FIG. 5, may be formed on a channel member 72 having a Velcro pad 74. The flexible lip extends outwardly from the outer surface of the flat leg 76 for being sealingly compressed against the window frame. A substantial number of alternative geometrical figurations are possible for forming the flexible sealing lip. FIG. 6 illustrates one such alternative embodiment having a flexible lip 80 and a second flexible lip 82 formed on a channel member 84.

Using current extrusion technology the channel members, such as those illustrated in FIG. 5 and FIG. 6, may be formed using conventional dual durometer extrusion techniques so that the channel member will be a unitary body with the lip portion formed of a substantially softer or more pliable material than the legs of the channel member. The softer more pliable material, such as a pliable vinyl, will give further improvement to the sealing qualities of the channel member.

Figure 10:
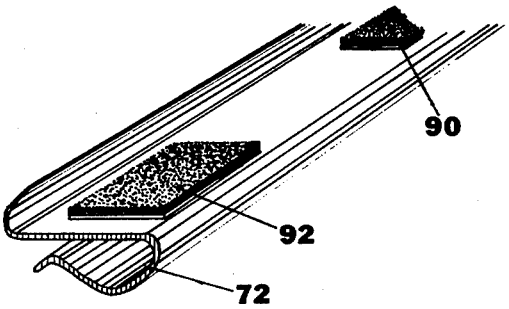
FIG. 10 is a view in perspective of the underside of the channel member illustrated in FIG. 9.

FIG. 10 illustrates spaced releasable fastener pads 90 and 92 of the Velcro type which are bonded to the outer surface of a channel member 72.

Figure 9:
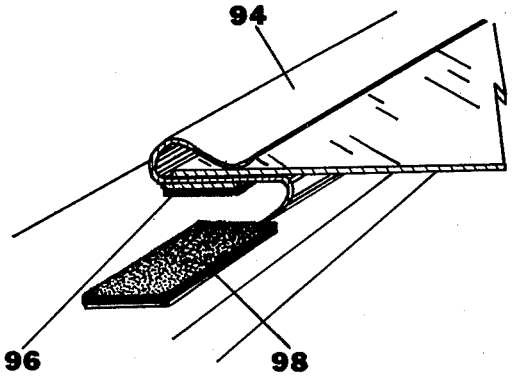
FIG. 9 is a view in perspective illustrating the use of releasable fasteners to provide an alternative embodiment of the invention.

FIG. 9 shows a channel member 94 of the same configuration as the channel member of FIG. 10 and which frames a relatively rigid window pane material. It has mating releasable fasteners 96 and 98 about to be pressed into releasable attachment.

Figure 11:
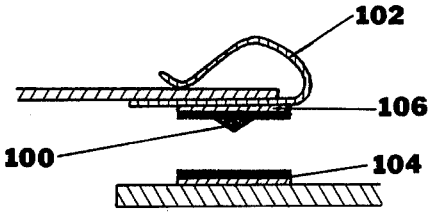
FIG. 11 is a view in section illustrating an alternative embodiment of the invention having gasket sealing means and releasable fastener means.
Figure 12:
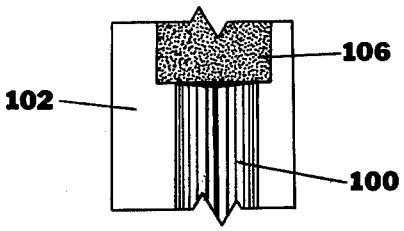
FIG. 12 is a bottom view of the underside of the channel member of FIG. 11.

Alternatively I show in FIG. 11 a narrowed strip of gasket material 100 longitudinally bonded to the outer surface of the flat leg of the channel 102 with spaced Velcro pads 104 and 106 of releasable fastener material bonded intermittently along the length of the gasket strip 100 and at corresponding positions on the window frame.

In order to provide maximum convenience to the consuming public and to permit "do-it-yourself" installation, the materials necessary for constructing a window barrier according to the present invention may be conveniently packaged in a kit. The kits are made to accommodate a variety of windows. Each kit includes: a supply of channel members of a convenient length, such as six feet, which are long enough for most windows which are normally encountered and in sufficient quantity to accommodate a specified number of windows; a supply of flexible, synthetic resin film which is dimensioned sufficiently large so that sheets cut from it can extend beyond the mounted channels and in a quantity sufficient to cover a specified number of windows; and a supply of rod-like members totalling the same as the total length of channel members. The kit may also advantageously include a roll of foam gasket strip having a pressure sensitive adhesive and a peelable cover layer on one major surface of the strip so that whenever additional sealing qualities are needed the gasket strip may be bonded to the channel members by means of the pressure sensitive adhesive on the channel members and the gasket strip may be bonded to the window frame by means of the pressure sensitive adhesive on the gasket strip.

One of the major advantages of the present invention is the ease and rapidity with which the embodiments of the invention may be assembled on the window frame.

For forming a film barrier the channel members are first mounted on the window frame so as to surround the window without any precise measurement being required. It is only necessary that the supplied film extend beyond the channel members after they are mounted. Because it is only necessary that the film extend beyond the channel members there is no need to precut the film to an exact size.

The channel members are cut or sawed to a convenient length with 45° mitered ends to form neat corners. After each channel member is cut to a convenient length, the release paper is pulled away and the channel member is pressed against the window frame. If desired, brads or screws may additionally be used. It is not essential that the window frame or the channel members be precisely square or that they be accurately parallel to each other.

After all the channel members are properly attached to the window frame, the flexible film 20 is held lightly with tape so that it extends slightly beyond the top channel member 14. A suitable rod-like member may be precut slightly shorter than the length of its associated channel member, preferably one inch shorter, in order to prevent corner lifting. It is then laid against the flexible film immediately above the channel of the channel member 14. The rod-like member is then pressed downwardly to force the top peripheral portion of the film and the rod-like member into the channel 14 beginning at the center and working out towards the ends. Once the rod-like member is forced past the narrowed region of lip 24, shown in FIG. 2, it will snap into a stable position. There is no need to hammer the rod-like member into position and therefore the risk of window or frame damage is eliminated.

After the film is clamped into position in the top channel 14, a second rod-like member is similarly cut to length and held against the film immediately below the channel of the lower channel member 10. The film may then be pulled downwardly so that it is comfortably taut and in a similar manner the rod-like member is then forced into the channel of the channel member 10.

The same procedures are then followed for inserting the film and the rod-like members into the channels 12 and 16 to complete the installation of the window barrier. If desired, although not necessary, most of any excess film extending beyond the channel members after installation may be trimmed away. Trimming too close, however, inhibits the ease of lining up the film for reuse during a subsequent season.

The plastic film secured in this manner is tightly held against any extra tension on the film sheet which might, for example, be caused by heavy winds or by a child pushing on the film. This occurs because such tensioning of the film would pull the film against the outer edge of the hook-shaped leg 24 of the channel members.

However, at the end of the winter season when the barriers are no longer desired, the film may very conveniently be removed by merely grasping the excess film which extends laterally outwardly of the channel members and pulling laterally or sideways away from the window. Pulling on this portion in a direction 180° oppositely to the direction of pull caused by high winds, will pull directly on the rod-like members causing them to easily pop out of the channels.

The film may conveniently be rolled up and stored and then later reused for the next winter season. It has no gummy or glue substances applied to it and has no holes in it. It will, in fact, not be necessary that the film be mounted in the exact identical position in the following year as it was in previous years. In the event of damage to the film it can easily be replaced. The channel members themselves are conveniently left permanently on the window frames with the rod-like members completely concealed in the channel members which in turn will be substantially hidden from view by curtains.

The kit described above may conveniently also include a supply of flexible, synthetic resin screening which may be used to replace the film during the summer months. It may further include a supply of pressure sensitive tabs which can be adhered to the film upon installation or after removal and labelled with window identification.

The window barriers constructed according to the present invention may also be advantageously used in factories, schools, commercial and public buildings, on storm doors and on garage doors, especially overhead doors. In case of damage the film can easily be changed or replaced. Such barriers may also be used on the exterior of the windows.

In the embodiment of the invention utilizing the relatively rigid window pane material, a window barrier is mounted to a window by first cutting the window pane member to a convenient size so that its side, bottom and top edges will be intermediate the edges of the window frame members.

Channel members are then cut with mitered corners to continuously surround the window pane member. After the channel members are positioned around the window pane as illustrated in FIG. 4 the release paper may be removed from the adhesive backed surface and the entire unit is then pressed against the window frame to seal and secure the window barrier to the frame. In ordinary use, such an installation would be permanent.

Figure 8:
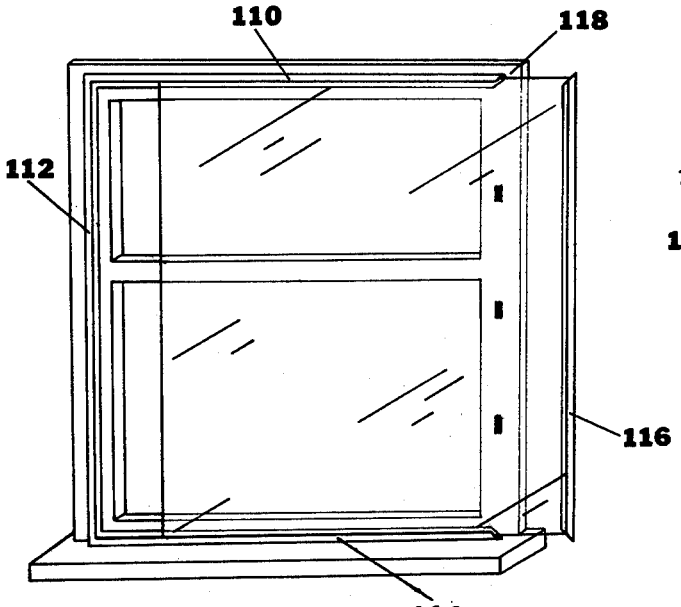
FIG. 8 is a front view of a window barrier of the relatively rigid window pane type mounted to a window frame.

FIG. 8 illustrates yet another alternative window barrier. The top, side and bottom channel members, 110, 112 and 114 are secured in the above manner. However, the other side member 116 does not utilize an adhesive fastening means. Instead the channel member 116 utilizes the channel member of the type illustrated in FIG. 9. In this manner the relatively rigid window pane 118 forming the secondary window barrier may be slid within the channels 110 and 114 into position along with the channel member 116. After the window pane member 118 is slid entirely into position, the channel member 116 is merely depressed against the window frame surface, causing the pads of releasable fastener material to be adhesively permanently bonded to the window frame. A later pull at the releasable fasteners will separate its releasable parts.

Where there is not sufficient clearance for the installation illustrated in FIG. 8, channel members may first be adhered to the opposite sides or to the top and bottom.

Channel members with releasable fasteners, such as adhesively backed Velcro pads, are attached to the other two sides of the window pane material. One exposed edge of the window pane material is inserted in one of the channels adhered to the frame, the pane is bent into an arc so that its opposite edge can then be inserted into the other channel adhered to the frame.

The window pane is then released and the opposite sides with the releasable fasteners are pressed against the window frame.

Removal is accomplished by reversing these steps.

Figure 13:
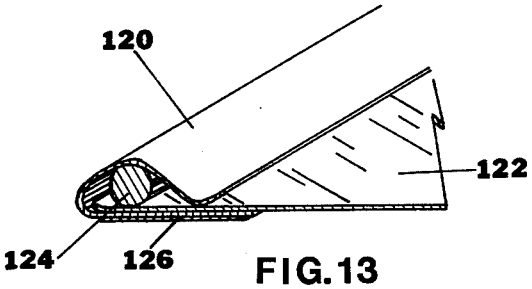
FIG. 13 is a view in perspective showing in cross section an alternative assembly using a relatively stiff film such as Mylar.

Some relatively stiff synthetic resin films, such as Mylar, are difficult or impossible to assemble as shown in FIG. 2. They do not stretch much. For such films, the channels, such as channel 120 shown in FIG. 13, are attached, for example, by an adhesive layer 126 to the window frame with the channels opening inwardly in the same manner as is done for rigid sheets.

However, the stiff film 122 is retained in the channel by a rod-like member 124 which is the same rod as described above for ordinary flexible films.

Figure 14:
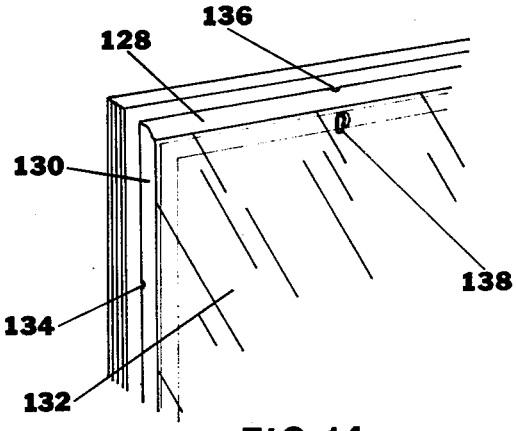
FIG. 14 is a view in perspective of a broken away segment of a window using the structure of FIG. 13.

FIG. 14 shows a corner of such a window with channel members 128 and 130 supporting the stiff film 132. Since there is no excess film which can be pulled to remove the rod-like members in order to remove the stiff film 132, I provide a hole through the bottom of each channel member 128 and 130 approximately intermediate its ends.

A small diameter rod, such as a nail, may be inserted into these holes 134 and 136 and used to push a portion of the rod-like members out of the channel members so that they can be gripped and completely pulled out.

A tab 138 is adhered to the film 132 to aid in their pulling it from the channel members.

It is to be understood that while the detailed drawings and specific samples given describe preferred embodiments of the invention, they are for the purposes of illustration only, that the apparatus of the invention is not limited to precise details and conditions disclosed and that various changes may be made therein without departing from the spirit of the invention which is defined by the following claims.

I claim:

1. A channel member for attachment to the frame of a building closure such as windows, doors and the like for retaining a window barrier, said channel member comprising a relatively flat leg for sealing against said frame and a relatively thin, substantially incompressible, flexible generally smoothly curved sheperd's crook-shaped leg integrally formed as a continuous extension of and attached to said flat leg and forming a longitudinal channel which opens substantially parallel to said flat leg and which is resiliently spreadable.

2. A channel member according to claim 1 wherein said channel member further comprises a flexible lip extending outwardly from the outer surface of said flat leg for sealingly contacting said frame.

3. A channel member according to claim 2 wherein said channel member is a dual durometer unitary body having said lip formed of a substantially more pliable material than said legs.

4. A secondary window barrier for attachment to the frame of a building closure such as a window, door, and the like, said barrier comprising:

(a) a plurality of channel members, each channel member having in cross-section a relatively flat leg for sealing against said frame and a relatively thin, substantially incompressible, flexible generally smoothly curved, shepherd's crook shaped leg integrally formed as a continuous extension of said flat leg and forming a longitudinal channel which opens substantially parallel to said flat leg and which is resiliently spreadable to receive and releasably retain the subsequently described film and rod-like members;

(b) means for attaching said channel members in end-to-end relationship around said frame with said channels opening away from the center of said frame;

(c) a flexible, synthetic resin film dimensioned to extend beyond said channels and having its peripheral regions extending through said channels; and (d) elongated, cylindrical rod-like members inserted in said channels and clamping the peripheral regions6of said film between said rod-like members and said channel members under spring tension.

5. A window barrier according to claim 4 wherein each of said channel members further comprises a flexible lip extending outwardly from the outer surface of said flat leg for sealingly contacting said frame.

6. A window barrier according to claim 5 wherein each of said channel members is a dual durometer unitary body having said lip formed of a substantially more pliable material than said legs.

7. A secondary window barrier for attachment to the frame of a building closure such as a window, door, and the like, said barrier comprising:

(a) a plurality of channel members, each channel member having in cross-section a relatively flat leg for sealing against said frame and a relatively thin, substantially incompressible, flexible generally smoothly curved shepherd's crook-shaped leg integrally formed as a continuous extension of said flat leg and forming a longitudinal channel which opens substantially parallel to said flat leg and which is resiliently spreadable, each channel member being a unitary body of dual durometer including a flexible lip formed of a substantially more pliable material than said legs and extending outwardly from the outer surface of said flat leg for sealingly contacting said frame;

(b) means for attaching said channel members in end-to-end relationship around said frame with said channels opening toward the center of said frame; and (c) a sheet of planar window pane material having its edges extending into said channels for retaining said window pane material in attachment to said frame.

* * * * *